United States Patent [19]

Kim

[11] Patent Number: 4,627,250

[45] Date of Patent: Dec. 9, 1986

[54] COMBINATION LOCK

[76] Inventor: Sung B. Kim, 4418 Pickett Rd., Fairfax, Va. 22032

[21] Appl. No.: 613,042

[22] Filed: May 22, 1984

[51] Int. Cl.[4] ..... E05B 37/00

[52] U.S. Cl. ..... 70/214; 70/313; 70/315; 70/DIG. 9

[58] Field of Search ..... 70/313–315, 70/304–306, 301, 312, 286, 219, 220, 213, 214, DIG. 9, 133, 291–293, 302

[56] References Cited

U.S. PATENT DOCUMENTS

| | | | |
|---|---|---|---|
| 1,161,218 | 11/1915 | Kaps | 70/313 |
| 1,620,757 | 3/1927 | Ferris | 70/214 |
| 1,684,908 | 9/1928 | Brunelle | 70/306 |
| 1,835,691 | 12/1931 | Breker | 70/306 |
| 2,132,201 | 10/1938 | Allman | 70/304 |
| 2,529,119 | 11/1950 | Wallach et al. | 70/313 |
| 2,536,429 | 1/1951 | Dury | 70/313 |

*Primary Examiner*—Robert L. Wolfe

*Assistant Examiner*—Lloyd A. Gall

*Attorney, Agent, or Firm*—Ziems, Walter & Shannon

[57] ABSTRACT

A resettable combination lock includes a plurality of user depressable buttons and a user-settable interposers for coupling selected ones of the buttons to a first button-actuation counter that counts correct button depressions and the other of the buttons to another button-actuation counter that counts incorrect button depressions. In addition, each button is coupled to a third counter that counts the total number of button actuations. In order to effect unlocking, the correct button sequence must be pushed to cause the first counter to count the proper number of correct button actuations and the third counter to count the proper number of button actuations without registering a single count on the second counter. The incrementing of a single count on the second counter, which indicates the depressing of a button not in the unlock sequence, will prevent the lock from being unlocked.

27 Claims, 16 Drawing Figures

COMBINATION LOCK

BACKGROUND OF THE INVENTION

The present invention relates to combination type locks and, more specifically, to resettable combination type locks.

Combination type locks for use in securing doors and other entryways have typically used an array of push buttons for entering a preselected access combination to permit unlocking. A typical lock can include, for example, ten push buttons or keys of which a selected subset, for example, four, must be depressed in order to effect unlocking. Prior combination type locks have suffered from a number of disadvantages that have prevented their widespread use. In some lock designs, a particular button can only be used once in a particular access combination. Thus, it is not possible for someone to use the same digit twice. This aspect, of course, limits the total number of access combinations available for the particular lock design. In still other designs, the buttons of a particular access combination need not be pushed in sequence, still further limiting the total number of available access combinations.

While the above-mentioned disadvantages relate to the manner by which combination buttons are made available, in many lock designs the combination lock mechanism is integrated with the door unlatching components so that an overtorquing of the unlatching mechanism will cause damage to the combination setting and controlling components.

Other drawbacks of existing designs relate to the manner in which the access combination is set or reset to effect unlocking. In some locks, the lock must be disassembled and various combination setting plates or other components removed and replaced or repositioned. As can be appreciated, such complexities in reconfiguring the access combination lessens the utility of the lock.

SUMMARY OF THE INVENTION

In view of the above, the present invention provides a combination lock that includes a user manipulatable device, such as push buttons, with at least one interposer associated with each user manipulatable device to selectively couple each manipulated device with either a first counter that counts correct entries or a second counter that counts incorrect entries. In addition, each user manipulatable device is coupled to a third counter that counts the total number of entries. In order to effect unlocking, the first counter must count the proper number of correct entries in the correct sequence, the third counter must count the proper number of entries, and the second counter must not register any incorrect entries.

In the preferred embodiment, a push button pad is provided with a predetermined number of user depressible buttons, each of which includes first and second force transmitting surfaces. A user settable interposer is associated with each button and can be set to couple each depressed button to a first counter that counts correct button depressions or, in the alternative, to a second counter that counts incorrect button depressions. Preferably both counters are in the form of rachet and pawl mechanisms that are incremented in response to the depressing of a button. In addition, a third counter, in the form of a toothed rack, is provided to count the total number of button depressions. An interlock member is allowed to effect unlocking only when the first counter has counted the proper number of correct button depressions, the third counter has counted the proper number of total button depressions, and no incorrect button depressions have been registered on the second counter.

The push buttons, in the preferred form, are coupled to double tined fork-like push bars with a user adjustable interposer positioned intermediate the tines. The interposers are in the form of rotatably mounted leaves that can be rotated to contact one tine or the other of a depressed push bar and transmit the motion to a first counter that increments in response to correct button depressions or to a second counter that increments in response to incorrect button depressions. In addition, the fork-like members are coupled to a third counter that counts the total number of button depressions. In the preferred embodiment, a plurality of interposers, e.g., four, are associated with each button depressible fork-like member so that a particular button can be used more than once in a desired access combination.

A principal objective of the present invention is, therefore, the provision of an improved combination lock that overcomes drawbacks of prior lock designs. More particularly, the present invention provides a combination lock in which the force applied to each button is identical regardless of whether or not a particular button is required as part of the unlock sequence, in which the buttons of the unlock sequence must be depressed in a correct sequence in order to effect unlocking, in which a particular button can be used more than once in an unlocking sequence, and in which the access combination can be reset easily to a new combination. Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 2:
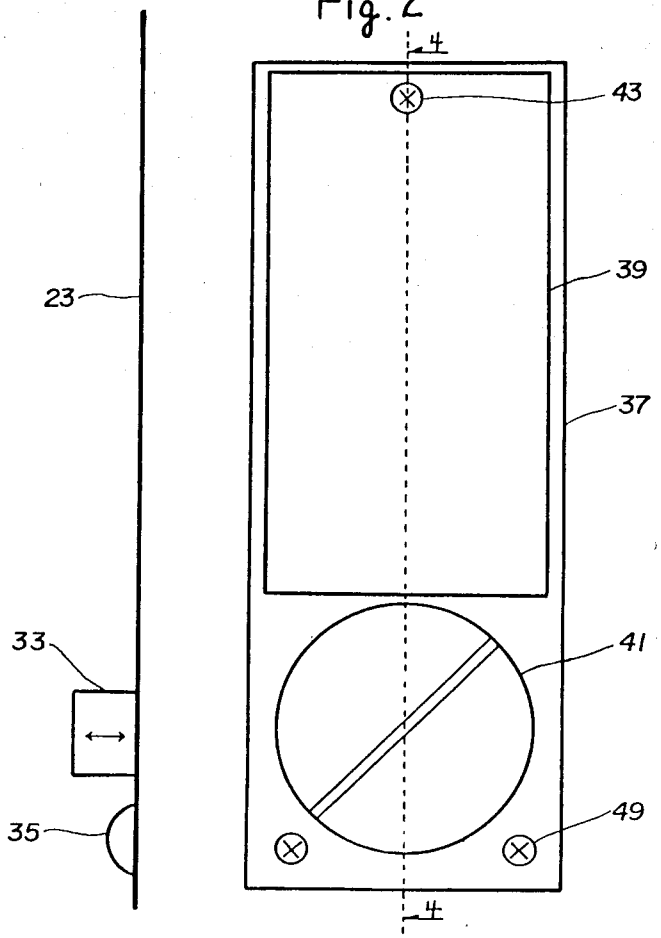
FIG. 2 is an elevational view of the interior side of the door illustrated in FIG. 1.
Figure 1:
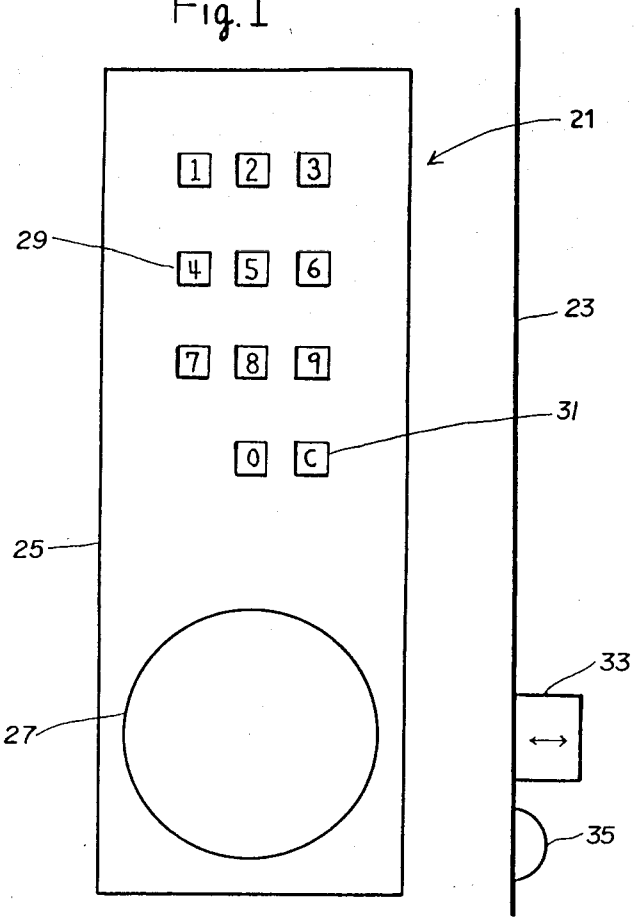
FIG. 1 is an elevational view of the exterior side of a door with a combination lock of the present invention in place.

A combination lock in accordance with the present invention is shown in FIGS. 1 and 2 and is designated therein generally by the reference character 21. As shown therein, the combination lock 21 is installed in a door 23 of conventional design and includes an exterior side (FIG. 1) with an exterior base plate 25 and an exterior door knob 27. A plurality of user-depressible numeric push buttons 29, labeled 0 through 9, and a separate clear button 31, labeled "C", extend through appropriate clearance openings in the exterior base plate 25. As explained more fully below, the push buttons 29 are depressible in a user-determined access combination or sequence to effect unlocking of the combination lock 21. The clear button 31 functions to clear or reset the combination lock 21 in the event a push button 29 is mistakenly depressed. When the push buttons 29 are depressed in proper sequence, the exterior door knob 27 can be rotated to retract a dead bolt 33 from a cooperating latch plate (not shown) to allow opening of the door 23. A spring-loaded detent ball 35 is mounted below the dead bolt 33 to retain the door 23 in its closed position when the dead bolt 33 is retracted. The interior side of the door 23 (FIG. 2) includes an interior cover plate 37 with a removable back cover 39 and an interior door knob 41. The back cover 39 is held in place by a threaded fastener 43 at the upper end and a tongue 45 and tongue-receiving slot 47 at the lower end.

Figure 3:
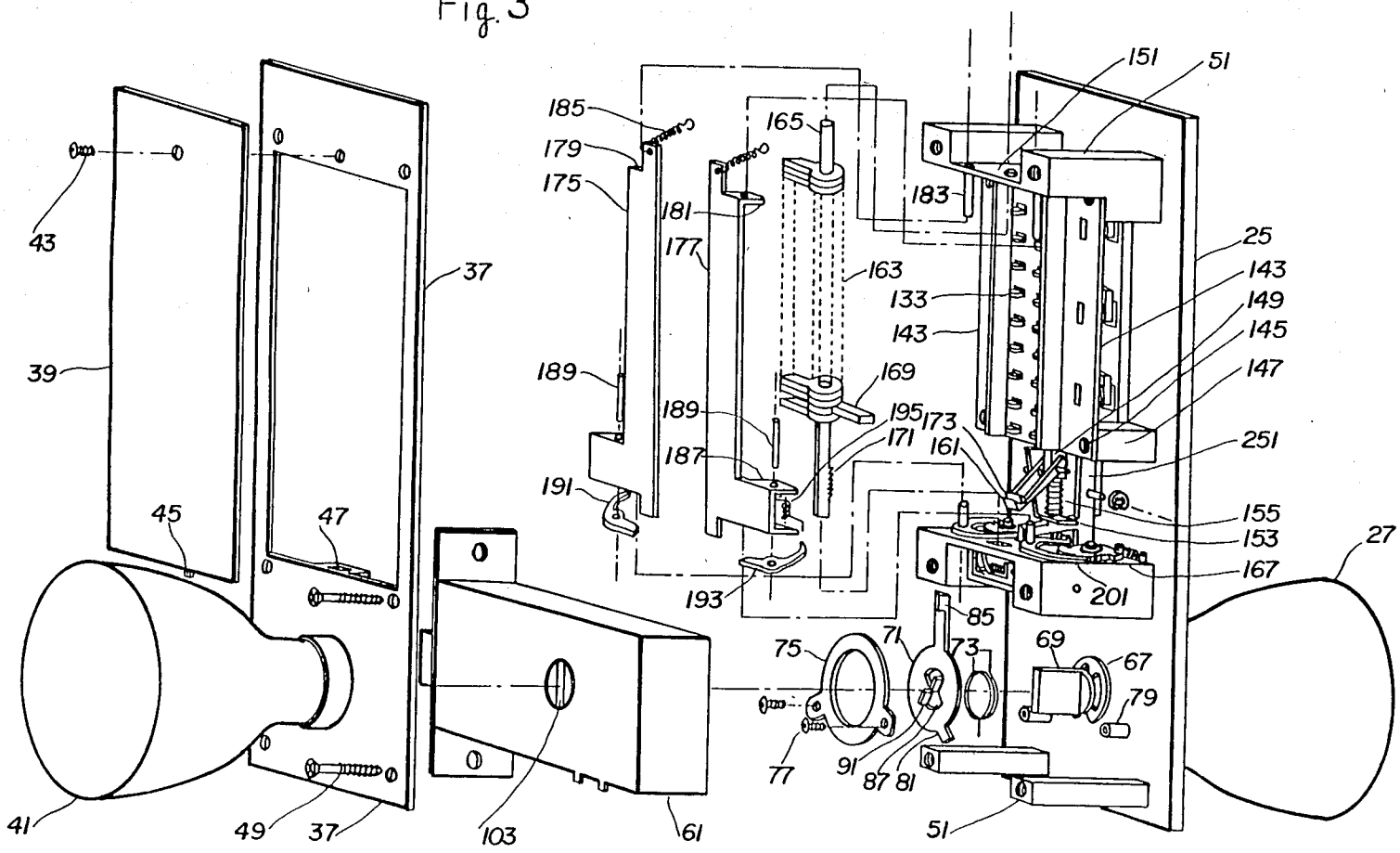
FIG. 3 is an exploded isometric view of the combination lock of the present invention.
Figure 4:
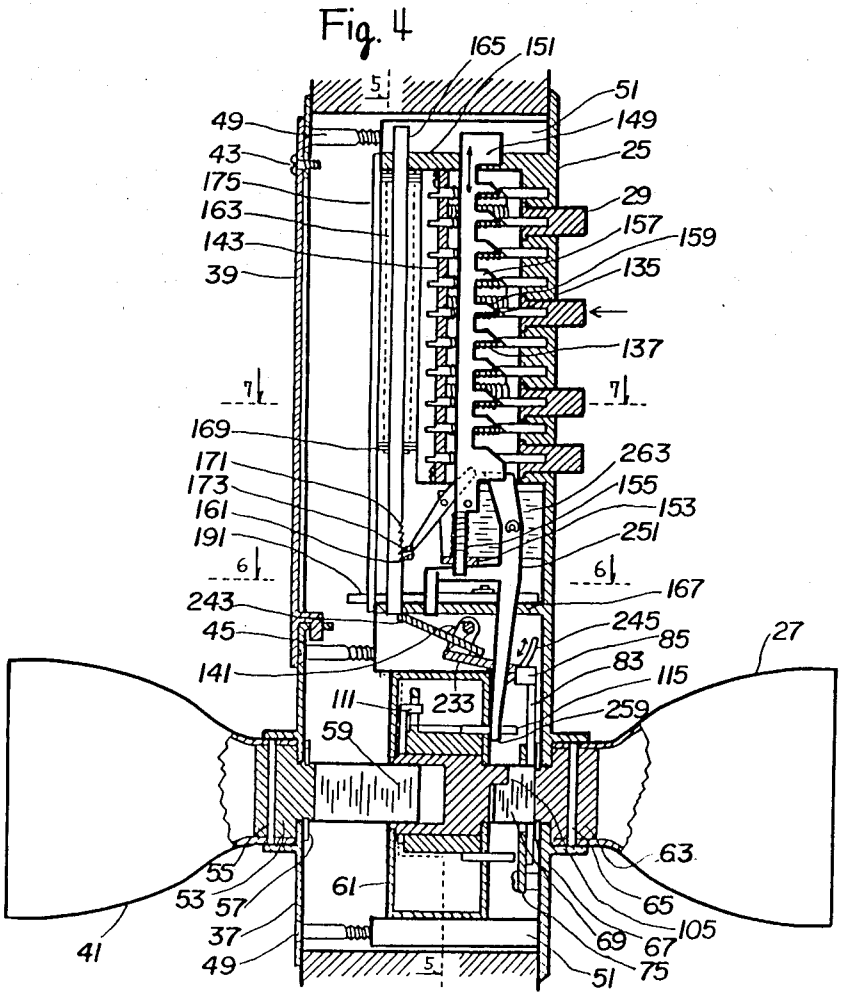
FIG. 4 is a side elevational view, in cross section, of the combination lock assembly taken along line 4—4 of FIG. 2.

As shown in FIGS. 3 and 4, the exterior base plate 25 and the interior cover plate 37 are mounted on the door 23 in general registration with one another with the below described combination lock mechanism mounted between the plates and with the exterior and interior door knobs 27 and 41 mounted on a common axis below the combination lock mechanism. The interior cover plate 37 and the exterior base plate 25 are connected by threaded fasteners 49 passing through clearance bores (unnumbered) in the interior cover plate 37 and engaging corresponding threaded studs 51 extending normally from the interior side of the exterior base plate 25.

As shown in FIG. 4, the interior door knob 41 is secured to an interior knob shaft 53 by a retaining pin 55. The interior knob shaft 53 is rotatably mounted in the interior cover plate 37 in an appropriate clearance bore and retained in place by an E-ring 57. The portion of the interior knob shaft 53 remote from the interior knob 41 is formed as a flat sided, diametric tab 59 for engaging a receiving slot (described below) in the bolt assembly 61 that carries the dead bolt 33, as described more fully below.

The exterior door knob 27 is connected to an exterior knob shaft 63 by a retaining pin 65 and is rotatably mounted in an appropriate clearance bore in the exterior base plate 25 and retained in place by an E-ring 67. The interior end of the exterior knob shaft 63 remote from the exterior knob 27 is formed as a flat sided, diametric tab 69.

As shown in the exploded isometric view of FIG. 3, a locking pawl 71 and a coiled torsion spring 73 are mounted over the tab 69 end of the exterior knob shaft 63 and retained in place by a pawl retaining cover 75 that is secured in place by threaded fasteners 77 passing through clearance holes to engage threaded mounting studs 79 that extend normally from the interior side of the exterior base plate 25. As shown in FIGS. 3 and 9–11, the locking pawl 71 includes an outwardly extending tab 81 located between the two mounting studs 79 to control the range of motion of the locking pawl 71. A locking arm 83 extends generally upwardly and includes a wedge-like tab 85 at its distal end to assist in effecting locking and unlocking, as described more fully below. The central portion of the locking pawl 71 is provided with a bi-sector shaped opening 87 that defines two inwardly pointed triangular lugs 89 with each lug 89 carrying an axially directed tab 91. As shown specifically in FIGS. 4, 9, and 10, the flat tab 69 end of the exterior knob shaft 63 extends through the bi-sector shaped opening 87. The exterior door knob 27 can accordingly be rotated through a range limited by engagement of the flat tab 69 end with the triangular lugs 89 and the tabs 91 carried by the lugs 89 when the locking pawl 71 is prevented from rotating. The coil torsion spring 73 is mounted to engage the locking arm 83 and urge the locking pawl 71 generally counterclockwise in FIGS. 3 and 9–11.

Figure 5:
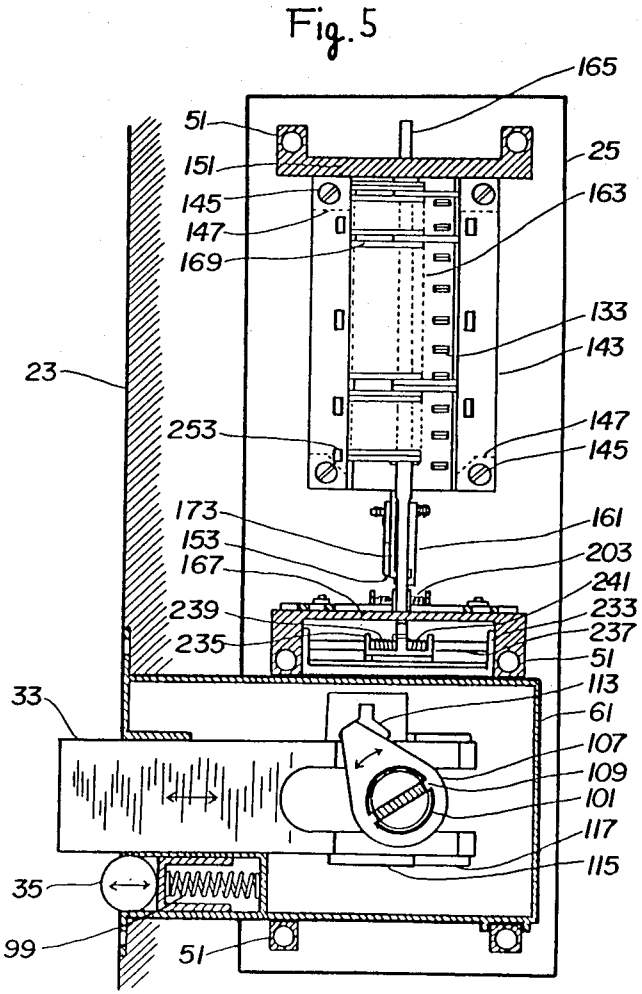
FIG. 5 is an elevational view, in cross section, of the combination lock taken along line 5—5 of FIG. 4.
Figure 8:
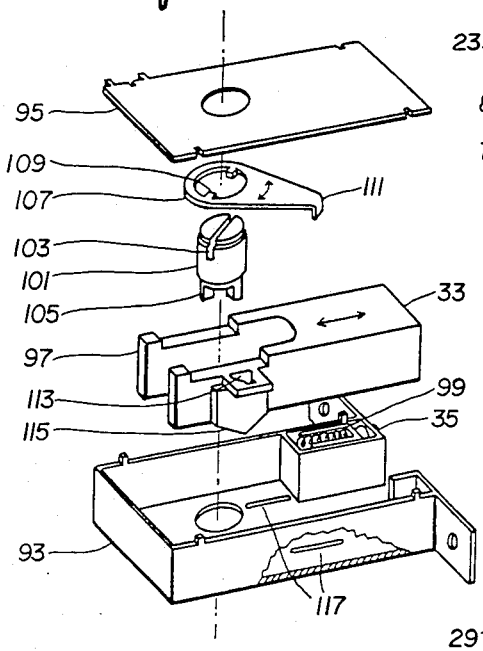
FIG. 8 is an exploded isometric view of the dead bolt assembly of the present invention.

The bolt assembly 61, shown in FIG. 3 and in exploded isometric view of FIG. 8, includes a bolt housing 93 and mating cover 95 with the bolt 33 slidably received within the assembled cover 95 and bolt housing 93 for controlled extension and retraction as indicated by the arrows in FIGS. 5 and 8. The interior end of the bolt includes spaced parallel legs 97 that define a generally U-shaped slot therebetween. A coiled compression spring 99 is retained within a compartment in the bolt housing 93 (FIGS. 5 and 8) to bias the detent ball 35 to its extended position.

A connector shaft 101 is rotatably mounted in appropriate openings in the cover 95 and the bolt housing 93 and positioned within the U-shaped slot. On the interior side, the connector shaft 101 is provided with a diametric slot 103, and, on the exterior side, the connector shaft 101 is provided with two diametrically aligned triangular lugs 105, the outlines of which are shown in dotted line illustration in FIGS. 9–11. A bolt driving pawl 107, which includes an opening with inwardly directed tabs 109, is mounted on the connector shaft 101 so that the tabs 109 are received within the diametric slot 103. Rotation of the interior door knob 41 will cause rotation of the flat end tab 59 and corresponding movement of the bolt driving pawl 107. The remote end of the bolt driving pawl 107 includes a tab 111 that is received within intersecting slot 113 formed in the dead bolt 33 so that rotation of the interior door knob 41 will cause the dead bolt 33 to extend or retract. As shown in FIG. 8, the dead bolt 33 is provided with triangular projections 115 that are received within and extend through elongated slots 117 formed in the dead bolt housing 93. As described below, the projections 115 function to actuate a clear bar each time the dead bolt 33 is moved between its retracted or extended positions to clear the combination lock 21.

Figure 9:
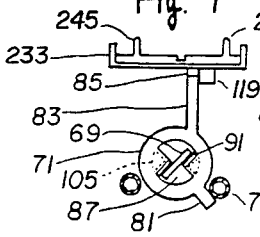
FIG. 9 is a detailed view of a locking pawl and locking block assembly when the door is locked from the inside.
Figure 10:
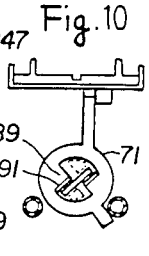
FIG. 10 is a detailed view of the locking pawl and locking block assembly of FIG. 9 when the door is opened from the interior.
Figure 11:
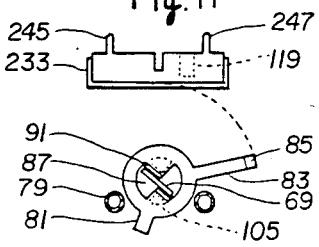
FIG. 11 is a detailed view of the locking pawl and locking block assembly when the door is opened from the exterior.

The mechanical relationship of the interior door knob 41 and the exterior door knob 27 can be appreciated from a consideration of FIGS. 9, 10, and 11. The locking pawl 71 is constrained by the tab 81 and the studs 79 for rotation between the position shown in FIG. 9 and the position shown in FIG. 11. In addition, a locking block 119, which is formed as part of a below described interlock assembly, is movable to a position to the right of the tab 85, as shown in FIG. 9, to effectively prevent clockwise rotation of the locking pawl 71 while the tab 81 prevents counterclockwise rotation. The torsion spring 73 resiliently biases the tab 85 away from the locking block 119 so that the tab 85 does not interfere with free movement of the locking block 119. In the "locked" configuration of FIG. 9, the locking pawl 71 is constrained from rotation in either direction. Were one to rotate the exterior door knob 27, the flat tab 69 end would rotate through a range of motion limited by the bi-sector shaped opening 87. With regard to rotation of the interior door knob 41, rotation is permitted in the counterclockwise direction until the triangular lugs 105 of the connector shaft 101, as represented in dotted line illustration in FIG. 9, contact the edges of the bi-sector shaped opening 87 with further counterclockwise rotation prevented by the tab 81 engaging the right-hand stud 79 in FIG. 9. Clockwise rotation of the interior door knob 41 will cause rotation of the bolt driving pawl 107 (FIGS. 5 and 8) to cause the dead bolt 33 to be retracted prior to the lugs 105 engaging the flat tab 69 end of the exterior knob shaft 63.

The locking block 119, as shown in FIGS. 9 and 10, is in a lower position to prevent movement of the locking pawl 71. To unlock the door 23, the locking block 119 is intentionally moved to a raised position, as shown in dotted line illustration in FIG. 11. In the configuration of FIG. 11, rotation of the exterior door knob 27 causes the flat tab 69 end to rotate clockwise in FIG. 11 until it engages the tabs 91 which, in turn, engage the triangular lugs 105 of the connector shaft 101. Thus, rotation of the exterior door knob 27 will cause rotation of the connector shaft 101 and the bolt driving pawl 107 to cause the bolt 33 to retract. Rotation of the exterior door knob 41 in the opposite direction will cause the flat tab 69 end to engage the other side of the triangular lugs 89, opposite the tabs 91, as well as the triangular lugs 105 to simultaneously rotate the connector shaft 101 and the bolt driving pawl 107 and rotate the locking pawl 71 counterclockwise to its initial or original locking position. As the tab 85 of the locking pawl 71 is returned to its initial locked position, the locking block 119 will be in its down position (as shown in FIGS. 9 and 10). As shown in the detail of FIG. 3, the tab 85 is provided with a sloped or inclined ramp that lifts the locking block 119 upwardly until the tab 85 clears and moves beyond the locking block 119 to allow the locking pawl 71 to return to its initial position.

The combination lock assembly, which controls the movement of the locking block 119, is located above the dead bolt assembly 61 between the exterior and interior plates 25 and 37. As best shown in FIGS. 1 and 4, the exterior base plate 25 includes three vertical columns of rectangular buttons 29. The buttons 29 of the center column (that is, the buttons labeled 2, 5, 8, and 0) have the overall structure shown in FIG. 14 in which each button 29 includes a lip or flange 121 at its lower end to retain the button in place. A fork-like push bar 123 includes a stem 125 that is received within a suitable bore (not shown) in the button 29. The push bar 123 includes first and second spaced parallel tines 127 and 129 connected to the stem 125 by a bridge 131. The remote ends 133 of the tines 127 and 129 define force transmitting surfaces which, as described below, are used to increment counters that count the number of correct and incorrect button depressions. The bridge 131 is provided with an inclined or sloped ramp surface 135 that serves, as described below, to positionally advance a combination setting assembly and to increment a third counter that counts the total number of button depressions. A return spring 137 is provided on each tine 129 and 127 to resiliently urge the buttons 29 to their respective undepressed positions.

Figure 13:
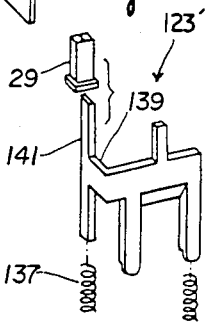
FIG. 13 is an isometric view of a push bar used for the push buttons of the left most button column of FIG. 1.
Figure 14:
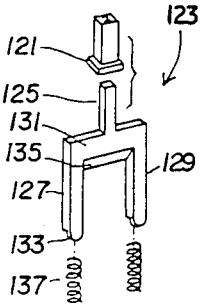
FIG. 14 is an isometric view of a push bar used for the push buttons of the center button column of FIG. 1.

The push buttons 29 of the left most column in FIG. 1 (that is, the buttons 1, 4, and 7) have a structure identical to that of the center column. As shown in FIG. 13, push bars 123', modified relative to the structure of FIG. 14, are utilized. The push bars 123' include an extension arm 139 and a guide bar 141 that is generally parallel to the tines and onto which the button 29 is mounted. Coiled return springs 137 are also provided on the tines 127 or 129 and the guide bar 141 to provide a restoring force.

The push bar structure (not shown) of the right most column of buttons in FIG. 1 (that is, the push buttons labelled 3, 6, and 9) is similar to that of the push bar 123' of FIG. 13 except that the extension arm and the guide bar are positioned on the opposite side of the bridge portion. The structures of the push bars for the left, center, and right column are such that the various push buttons, when assembled in the exterior base plate 25 as described below, have their respective tines arranged in an overlying arrangement in parallel vertical planes.

The push buttons 29 and the push bars 123 are mounted between the exterior base plate 25 and an intermediate mounting plate 143 that is secured (as shown in FIG. 3) by threaded fasteners 145 engaging fastener receiving studs 147 secured to the interior side of the base plate 25. The push buttons 29 pass through appropriate openings in the base plate 25 while the remote ends 133 of the tines and guide bars, depending upon the particular push bar, project through appropriately sized clearance bores (unnumbered) in the intermediate mounting plate 143. The coiled return springs 137 are mounted on their respective tines or guide bars and bear against the intermediate mounting plate 143 to resiliently urge the respective push bars 123 and push buttons 29 to their initial undepressed positions. When a particular push button 29 is depressed, the remote ends 133 of its tines 127 and 129 advance beyond the intermediate mounting plate 143 toward the interior cover plate 37.

As shown in FIG. 4, an advance bar 149 is mounted on a generally vertical axis between the interior side of the exterior base plate 25 and the intermediate mounting plate 143 and between the tines of the various push bars 123. The advance bar 149 is mounted for relative reciprocating movement at its upper end in a clearance slot (not shown) formed in an upper support wall 151, which extends generally perpendicular from the exterior base plate 25, and at its lower end in a similar manner in a lower support partition 153. A coiled return spring 155, in compression, is mounted at the lower end of the advance bar 149 to resiliently urge the advance bar 149 to its upper position. The advance bar 149 carries a projection 157 (FIG. 4) for each push bar 123 in the lock. The projections 157 each have a ramp surface 159 at their remote end that complements the ramp surface 135 formed on the bridge 131 of each push bar 123. Depression of a selected push button 29 will cause the connected push bar 123 to advance to the left in FIG. 4 with the two ramped surfaces 135 and 159 engaging to push the advance bar 149 downwardly. When the push button 29 is released, its connected push bar 123 retracts to allow the advance bar 149 to return to its initial position in response to the urging of its return spring 155.

As best shown in FIG. 3, an advance pawl 161 is pivotally carried at the lower end of the advance bar 149 and is moved downwardly with each downward movement of the advance bar 149 to increment a toothed rack, described more fully below, that counts the total number of push button 29 actuations.

A combination setting assembly, designated generally by the reference character 163, is mounted immediately adjacent the intermediate mounting plate 143 and between the remote ends 133 of the tines 127 and 129 that project from the intermediate mounting plate 143. As shown in FIG. 3, the combination setting assembly 163 includes a generally vertically aligned bar 165 that is received, at its upper end, in a clearance bore (unnumbered) formed in the upper support wall 151 and, at its lower end, in another clearance bore formed in the lower support wall 167. The intermediate and upper portions of the bar 165 are cylindrical and carry a plurality of combination setting interposers 169 that can be rotated relative to the bar 165 to one of two combination setting positions as shown generally in FIG. 3. In the preferred embodiment, four combination setting interposers 169 are mounted on the bar 165 for each of the push buttons 29. The lower end of the bar 165 includes a toothed rack 171 with the pitch of the individual teeth generally equal to the thickness dimension of the individual combination setting interposers 169. The advance pawl 161 mounted at the lower end of the advance bar 149, as shown in FIG. 3, engages the toothed rack 171 of the bar 165 and acts to push the bar downwardly with each button actuation. In addition, a restraining pawl 173, pivotally mounted on a supporting wall surface 263 of the exterior base plate 25, also engages the toothed rack 171, as shown in FIG. 4. With each depression of the push buttons 29, the advance bar 149 and connected advance pawl 161 are caused to push the bar 165, with the combination setting interposers 169, downwardly by a distance equal to the thickness of one of the combination setting interposers 169 with the restraining pawl 173 maintaining the bar 165 in its newly incremented position. The bar 165 is resiliently urged in the vertical direction to its initial or starting position by an interlock assembly described more fully below.

Figure 6:
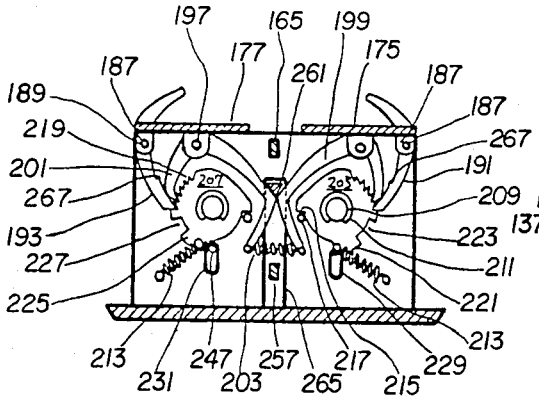
FIG. 6 is a top view, in cross section, of the combination lock taken along line 6—6 of FIG. 4.
Figure 7:
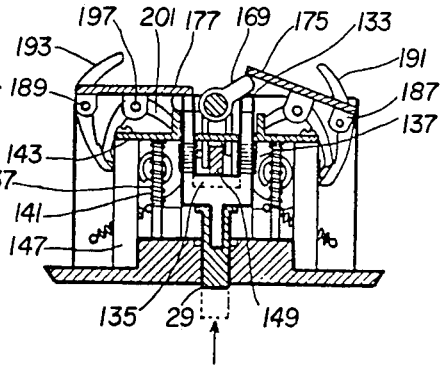
FIG. 7 is a cross sectional view of the combination lock assembly taken along line 7—7 of FIG. 4 with an exemplary push button shown in its depressed position.

As shown in FIG. 3, first and second actuation panels 175 and 177 are pivotally mounted on the upper and lower support walls 151 and 167, respectively. Each of the panels 175 and 177 has a vertical height coextensive with the combination setting interposers 169 with apertured mounting tabs 179 and 181, respectively, formed at the upper ends which are pivotally received on pins 183 depending from the underside of the upper support wall 151. A coiled return spring 185, in tension, is provided at the upper end of each actuation panel 175 and 177 to urge the panels to their respective initial positions generally parallel to the exterior base plate 25. As shown in FIGS. 3, 6, and 7, the lower end of each panel 175 and 177 includes spaced parallel and apertured tabs 187. As shown in FIGS. 3 and 6, an incrementing pawl 191 is mounted for relative rotation on the pin 189 for coaction with the actuation panel 175 with a pin-mounted torsion spring 195 to resiliently urge the pawl 191 onto a below described rachet wheel. In a similar manner, another incrementing pawl 193 is mounted on the other pin 189 for coaction with the actuation panel 177 with a pin-mounted torsion spring 195 resiliently urging the pawl onto another below described rachet wheel.

Each of the actuation panels 175 and 177 is movable from their respective initial positions, as represented by the panel 177 in FIG. 7, to a pivoted or extended position, as represented by the actuation panel 175. One or the other of the actuation panels 175 and 177 is caused to pivot by depression of one of the push buttons 29. As the remote ends 133 of the tines 127 and 129 advance beyond the intermediate mounting plate 143, one of the tines will engage the associated interposer 169, which can be set in one of two orientations, rotating the contacted interposer 169 to cause it to, in turn, pivot the corresponding actuation panel 175 or 177.

As shown in FIG. 6, each of the actuation panels 175 and 177 is provided with tab mounts 197 along a midline of each panel to carry holding pawls 199 and 201, respectively. The holding pawls 199 and 201 are connected by a common restoring spring 203 that urges the incrementing pawls onto the below described rachet wheels.

As shown in FIG. 6, first and second rachet wheels 205 and 207 are rotatably mounted in respective studs 209 and retained in place with E-rings 211 or the equivalent thereof. A tensioned coil spring 213 is connected between a pin (unnumbered) on the rachet wheel 205 and another pin (unnumbered) on the upper surface of the lower support wall 167 to resiliently urge the rachet wheel 205 in a counterclockwise direction until a projecting flat 215 on the rachet wheel engages a stop pin 217. In a similar manner, another tensioned coil spring 213 is connected to the rachet wheel 207 to resiliently urge the rachet wheel in the clockwise direction until a projecting flat 215 on the rachet wheel is resiliently urged against another stop pin 217. Each rachet wheel 205 and 207 includes a peripheral portion with rachet teeth 219 that are engaged by the pawls 191 and 199 in the case of the rachet wheel 205 and the pawls 201 and 193 in the case of the rachet wheel 207.

When a particular push button 29 is depressed, either the actuation panel 175 or the actuation panel 177, depending upon the user-adjusted position of the associated interposer 169, will be pivoted and the incrementing pawl carried by the pivoted actuation panel will increment the associated rachet wheel by one tooth. For example, where the actuation panel 177 is pivoted, the incrementing pawl 193 will increment the rachet wheel 207 one tooth in the counterclockwise direction with the holding pawl 201 holding the newly incremented rachet wheel in place. Likewise, where the actuation panel 175 is pivoted, the incrementing pawl 191 will increment the rachet wheel 205 one tooth in the clockwise direction with the holding pawl 199 holding the newly incremented rachet wheel in place.

Each of the rachet wheels 205 and 207 is provided with a peripheral tab portion and a peripheral indent or slot immediately adjacent the tab. More specifically, the rachet wheel 205 is provided with a tab 221 and a slot 223, and the rachet wheel 207 is provided with a projecting tab 225 and a slot 227. Elongated access slots 229 and 231 are provided in the lower support wall 167 and are positioned to be covered and uncovered by the projecting tabs or slots of the rachet wheels 205 and 207 respectively, as described more fully below.

In operation, the rachet wheel 207 and associated components are used to count or increment "incorrect" push button 29 depressions while the rachet wheel 205 and its associated components are used to count or increment "correct" push button 29 actuations. Thus, when a first correct push button 29 is depressed, the actuation panel 175 is rotated about its pivot pin 183 to the position shown in FIG. 7 to cause the incrementing pawl 191 to rotatably increment the rachet wheel 205 one tooth in the clockwise direction and cause the projecting tab 221 to cover or block the elongated slot 229. With each additional correct push button 29 actuation, the rachet wheel 205 is again incremented in the clockwise direction until the last correct push button is depressed in the access combination to cause the projecting tab 221 to move beyond the elongated access slot 229 and unblock the elongated slot 229. On the other hand, the rachet wheel 207 is utilized to count incorrect push button 29 depressions and, as shown in FIG. 6, is initially positioned so that the elongated slot 231 is initially uncovered. When a push button 29 not in the access combination is depressed in which the associated interposer 169 is rotated to a position to cause rotation of the actuation panel 177, the rachet wheel 207 is incremented in the counterclockwise direction by the incrementing pawl 193 to cause the projecting tab 225 to cover the elongated slot 231. The peripheral width of the projecting tab 225 is such that the tab continues to cover the elongated slot 231 with successive incorrect button actuations. Thus, where a correct push button 29 for the access combination is depressed, only the rachet wheel 205 is incremented. The associated elongated slot 229 will be blocked or covered by the projecting tab 221 of the rachet wheel 205 until the last of the correct push buttons in the access combination is activated so that the tab 221 will be incremented out of its blocking position. Where one or more of the push buttons 29 not in the access combination is depressed, the elongated slot 231 will be covered by the projecting tab 225 of the rachet wheel 207.

The rachet wheels 205 and 207 can be reset to their initial positions by operation of the clear button 31 and a connected clear bar, as described more fully below. In FIG. 6, the clear bar is represented by a clearing extension in cross section at 261. When the clear button 31 is depressed, the clearing extension 261 moves downwardly in FIG. 6 to force the holding pawls 199 and 201 out of engagement with their respective rachet wheels 205 and 207. The holding pawls 199 and 201 also engage the incrementing pawls 191 and 193 to likewise cause these pawls to disengage from the rachet wheels 205 and 207 and allow the springs 213 to return the rachet wheels to their respective initial positions.

Figure 15:
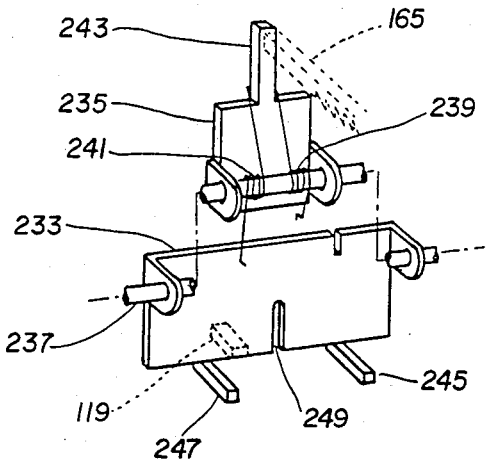
FIG. 15 is an expanded isometric view of an interlock mechanism.

The interlock assembly, as shown in side view in FIG. 4 and in exploded isometric in FIG. 15, is located in a cavity formed beneath the lower support wall 167, above the exterior knob shaft 63. As shown in FIG. 15, the interlock assembly includes a first member 233 and a second member 235, each having a set of apertured tabs (unnumbered) with a common shaft 237 extending through the apertured tabs to pivotally connect the first and second members 233 and 235. A first spiral torsion spring 239 is mounted on the shaft 237 to resiliently bias the first and second members apart at their upper surface. A second spiral torsion spring 241 is also mounted on the shaft 237 with one end of this latter spring contacting the second member 235 and the other end engaging the lower support wall 167 to bias the second member so that the locking block 119 on the first member (FIGS. 9 and 10) is urged to its lower position.

The second member 235 includes a tab 243 that is designed to be engaged by the lower end of the bar 165 of the combination setting assembly, as shown in dotted line illustration in FIG. 15. The first member 233 includes the above described locking block 119, upwardly extending prongs 245 and 247, and a slot 249 formed intermediate the prongs 245 and 247 for accommodating the lower end of the below described clear bar. The interlock assembly is mounted beneath the lower support wall 167 with the common shaft 237 mounted in the threaded studs 51 in such a manner that the lower end of the bar 165 of the combination setting assembly is positioned for contacting the tab 243 of the second member 235 while the prongs 245 and 247 are positioned to pass through the elongated slots 229 and 231 described above in relationship to the operation of the rachet wheels 205 and 207, respectively. As described below, the first member 233 can pivot about the shaft 237 from a lower position in which the locking block 119 can engage the end 85 of the locking pawl 71 (FIGS. 9 and 10) to an upper position in which the prongs 245 and 247 extend through the elongated slots 229 and 231.

In operation, the bar 165 of the combination setting assembly is incremented downwardly by successive push button 29 depressions, regardless of whether or not the particular button actuations were correct or incorrect. With each successive button actuation, the bar 165 pushes the tab 243 downwardly with the spring-connected second and first members 235 and 233 rotating about the shaft 237 to advance the prongs 245 and 247 through their respective slots 229 and 231. As described above, where the correct number of push buttons 29 have been depressed in the proper access sequence, both of the elongated slots 229 and 231 will be unobstructed by their respective rachet wheels 205 and 207 so that the prongs 245 and 247 will advance upwardly through the elongated slots 229 and 231 to allow the locking block 119 to rise above the end 85 of the locking pawl 71 (FIGS. 10 and 11) and allow the door 23 to be opened as described above. In the case where a push button 29 not in the correct access sequence has been depressed, the rachet wheel 207, which is incremented by incorrect button actuations, will be incremented so that its projecting tab 225 will cover the elongated slot 231 and prevent the prong 247 from advancing through the elongated slot 231. Accordingly, the locking block 119 will remain in its lower position (FIGS. 9 and 10) to prevent unlocking of the door 23.

Figure 12:
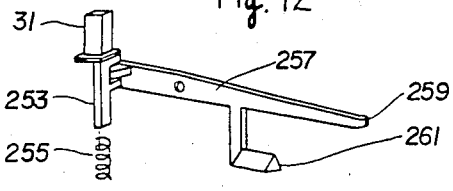
FIG. 12 is an isometric view of the clear button and associated clear bar.

The clear bar, shown in FIG. 12 and designated generally therein by the reference character 251, is used to clear or reset the entire lock mechanism. As shown, the clear bar 251 includes a guide bar 253 onto which a coiled restoring spring 255 is mounted with the "C" push button 31 carried on the opposite side of the guide bar 253. A clearing arm 257 extends from the guide bar 253 and includes a remote end 259 and a wedge-shaped clearing extension 261 positioned intermediate the ends of the clearing arm 257. The clear bar 251 is mounted, as best shown in FIG. 4, with the clear button 31 passing through an appropriate bore in the exterior base plate 25 and the guide bar 253 received within a clearance bore (not shown) formed in the intermediate mounting plate 143. In addition, the clearing arm 257 is connected for pivoting motion by a pin (unnumbered) extending from an appropriately positioned supporting wall surface 263. The clearing extension 261 passes through an opening 265 in the lower support wall 167, as shown in FIG. 6, to bear against the two holding pawls 199 and 201. When the clear button 31 is depressed, as described above, the wedge-shaped clearing extension 261 will release the holding pawls 199 and 201 and the incrementing pawls 191 and 193 to allow the springs 213 to return the rachet wheels 205 and 207 to their initial positions. In addition, when the clear button 31 is depressed, the upper end of the clearing arm 257 advances to engage the upper end of the restraining pawl 173, which will in turn engage the advance pawl 161, to release the bar 165 of the combination setting assembly and allow the bar 165 to return to its initial position. The remote end 259 of the clearing bar 251 is positioned to contact the triangular projection 115 that extends through the guide slot 117 of the dead bolt assembly 61, as described above. When the dead bolt 33 is retracted manually using the interior door knob 27 or the exterior door knob 41, the triangular projection 115 contacts the end 259 of the clearing arm 257 to pivot the clearing arm to cause the clearing extension 261 to reset the rachet wheels 205 and 207 as described above.

The access sequence or combination can be set by the user without removal of the combination lock 21 from the door 23. In order to initially set or subsequently reset the access combination, the back cover 39 (FIG. 3) is removed from the interior cover plate 37 to present the actuation panels 175 and 177 to the user. Both actuation panels 175 and 177 are then manually moved to their respective open positions and are maintained in that position by the slots 223 and 227 of the rachet wheels 205 and 207 which engage notches 267 formed in the incrementing pawls 191 and 193 to present the combination setting assembly to the user. All of the interposers 169 are then rotated manually to the left in FIG. 5 to their respective incorrect positions. The interposers 169 may be rotated with the aid of a wire hook (not shown) or similar pick-like tool. Once the interposers 169 are rotated, the first button 29 in the desired access combination is pushed to cause the corresponding interposer 169 to be pushed out of registration with the others. This interposer 169 is then rotated to its correct position, to the right in FIG. 5. Since the bar 165 of the combination setting assembly is advanced downwardly with each push button depression, another interposer 169 will be presented to each push bar 123. The next push button 29 in the sequence is then depressed to, in turn, push another interposer 169 out of registration with the others. This interposer 169 is then rotated to its correct position to the right in FIG. 5. The process is continued until all of the interposers 169 of the desired access combination are identified by push button 29 manipulations and rotated to the correct position. Since another interposer 169 is presented to each push bar with each push button 29 depression, it is possible to use the same push button 29 more than once in a particular access combination. As can be appreciated by those skilled in the art, there is no need to remove the combination lock 21 from the door 23 or remove and replace parts in order to set or reset the access combination. Once the access combination has been set as described above, the incrementing pawls 191 and 193 can be manually released to allow the actuation panel 175 and the actuation panel 177, respectively, to return to their initial positions. In the alternative, the clear button 31 can be depressed to cause the clearing extension 261 (FIG. 6) to move the holding pawls 199 and 201 and the incrementing pawls 191 and 193 out of engagement with the rachet wheels 205 and 207, respectively.

Figure 16:
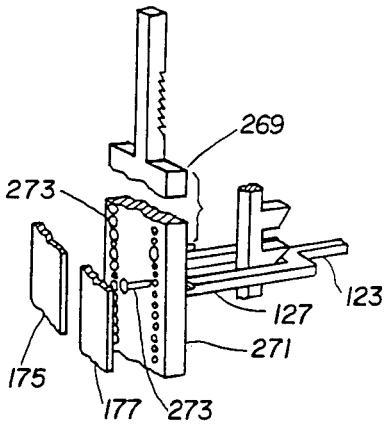
FIG. 16 is a partial view of an alternate embodiment of a combination setting assembly of the present invention.

Although the combination setting assembly described above is preferred, it can be appreciated by those skilled in the art that other combination setting structures are equally suitable. For example, an alternate combination setting assembly is shown in FIG. 16 and designated generally therein by the reference character 269. As shown, a combination setting plate 271 is provided with two parallel rows of openings. The push bars 123 are mounted on one side of the plate 271 with the tines 127 and 129 aligned with the openings and the actuation panels 175 and 177 mounted on the other side. A combination setting pin 273 is provided in one of the two holes for each push bar 123 so that actuation of the push bar will cause one of its two tines to push the pin 273 beyond the combination setting plate 271. Depending upon the position of the pin, e.g. the correct or incorrect opening, the actuation panel 175 or the actuation panel 177 will be pivoted to increment the respective rachet wheel as described above.

Thus it will be appreciated from the above that as a result of the present invention, a highly effective combination lock assembly is provided by which the principal objective, among others, is completely fulfilled. It will be equally apparent and is contemplated that modification and/or changes may be made in the illustrated embodiment without departure from the invention. Accordingly, it is expressly intended that the foregoing description and accompanying drawings are illustrative of preferred embodiments only, not limiting, and that the true spirit and scope of the present invention will be determined by reference to the appended claims.

What is claimed is:

1. A combination lock comprising:

a plurality of user-operable means operable through an operating stroke between first and second positions;

first counter means for counting operating strokes including a respective first movably mounted member movable from an intial position to successive unique positions in response to successive operating strokes;

second counter means for counting operating strokes including a respective second movably mounted member movable from an initial position to successive unique positions in response to successive operating strokes;

combination setting means for connecting selected ones of said user-operable means to said first counter means to enable counting by said first counter means of the operating strokes of said selected user-operable means and for connecting the non-selected ones of said user-operable means to said second counter means to enable counting by said second counter means of the operating strokes of said non-selected user-operable means;

third counter means responsive to each operating stroke of said selected and non-selected user-operable means for counting the operating strokes thereof and including a respective third movably mounted member movable from an initial position to successive unique positions in response to each successive operating stroke of said selected and non-selected user-operable means; and interlock means movable from an initial position to a second position when said first counter means counts a predetermined number of operating strokes of said selected user-operable means, said second counter means has not counted operating strokes of said non-selected user-operable means, and said third counter means has counted a predetermined number of operating strokes of said selected and non-selected user-operable means.

2. The combination lock of claim 1, wherein:

said interlock means comprises a locking member movable between first and second positions, said first and second counter means each including movement stopping means, said movement stopping means permitting movement of said locking member to its second position when said first counter means counts a predetermined number of operating strokes and said second counter means has not counted operating strokes.

3. The combination lock of claim 2, wherein:

said third counter means is coupled to said locking member to urge said locking member to its second position when said third counter means has counted a predetermined number of operating strokes.

4. The combination lock of claim 3, wherein:

said counter means urges said locking member to its second position on the last count of said predetermined number of operating strokes.

5. A combination lock comprising:

a plurality of push buttons actuatable through an actuation stroke between first and second positions;

first counter means for counting actuation strokes including a respective first movably mounted member movable from an initial position to successive unique positions in response to successive actuation strokes;

second counter means for counting actuation strokes including a respective second movably mounted member movable from an initial position to successive unique positions in response to successive actuation strokes;

combination setting means for connecting selected ones of said push buttons to said first counter means to enable counting by said first counter means of the actuation strokes of said selected push buttons and for connecting the non-selected ones of said push buttons to said second counter means to enable counting by said second counter means of the actuation strokes of said non-selected push buttons;

third counter means responsive to each actuation stroke of said selected and non-selected push buttons for counting the actuation strokes thereof and including a respective third movably mounted member movable from an initial position to successive unique positions in response to each successive actuation stroke of said selected and non-selected push buttons; and interlock means movable from an initial position to a second position when said first counter means counts a predetermined number of push button actuation strokes of said selected push buttons, said second counter means has not counted actuation strokes of said non-selected push buttons, and said third counter means has counted a predetermined number of actuation strokes of said selected and non-selected push buttons.

6. The combination lock of claim 5, wherein:

at least one of said first, second, and third counter means comprises a rachet means incrementable to successive unique positions in response to push button actuation strokes.

7. The combination lock of claim 6, wherein:

said first and second counter means are defined by said rachet means.

8. The combination lock of claim 6, wherein said ratchet means comprises:

a rotatably mounted rachet wheel, a first pawl for engaging said rachet wheel to positionally increment said wheel in response to a push button actuation stroke, and a second pawl for holding said ratch wheel in an incremented position.

9. The combination lock of claim 8, wherein:

each of said push buttons includes first and second force transmitting surfaces for transmitting a force when actuated;

said combination setting means comprises at least one interposer means associated with each of said push buttons, said interposer means movable to at least one of two positions, said interposer means in said first position engagable by said first force transmitting surface of the respective push button and in said second position engageable by said second force transmitting surface of the respective push button; and coupling means connected to said incrementing pawl of said first counter means to be engaged by interposers in said first position for causing said first counter means to count actuations of said push buttons and connected to said incrementing pawl of said second counter means to be engaged by interposers in said second position for causing said second counter means to count actuations of said push buttons.

10. The combination lock of claim 8, wherein:

each of said push buttons includes first and second force transmitting surfaces for transmitting a force when actuated;

said combination setting means comprising a plurality of interposer means associated with each of said push buttons, each of said plural interposer means associated with each push button movable to at least one of two positions, said interposer means in said first position engageable by the first force transmitting surface of the respective push buttons and in said second position engageable by said second force transmitting surface of the respective push button;

means connected to said combination setting means for successively presenting each of said plural interposer means associated with each push buttons to said associated push button with successive push button actuations; and coupling means connected to said incrementing pawl of said first counter means to be engaged by interposers in said first position to cause said first counter means to count actuations of said push buttons and connected to said incrementing pawl of said second counter means to be engaged by interposers in said second position to cause said second counter means to count actuations of said push buttons.

11. The combination lock of claim 5, wherein:

at least one of said first, second, and third counter means comprises a toothed rack and at least one cooperating pawl, said at least one pawl incrementing said rack in response to push button actuation.

12. The combination lock of claim 11, wherein:

said third counter means is defined by said toothed rack and at least one cooperating pawl.

13. The combination lock of claim 12, further comprising:

a second pawl for holding said toothed rack in an incremented position.

14. The combination lock of claim 5, wherein:

said combination setting means comprises at least one interposer means associated with each of said push buttons, said interposer means movable to at least one of two positions, said interposer means in said first position connecting their respective push buttons to said first counter means when the respective push button is actuated to count the actuation stroke thereof and in said second position connecting their respective push buttons to said second counter means when the respective push button is actuated to count the actuation stroke thereof.

15. The combination lock of claim 5, wherein:

said combination setting means comprises a plurality of interposer means associated with each of said push buttons, each of said plural interposer means associated with each push button movable to at least one of two positions, said interposer means in said first position connecting their respective push buttons to said first counter means when the respective push button is actuated to count the actuation stroke thereof and in said second position connecting their respective push buttons to said second counter means when the respective push button is actuated to count the actuation stroke thereof; and means connected to said combination setting means for successively presenting each of said plural interposer means associated with each push button to said associated push button with successive actuations of a push button.

16. The combination lock of claim 5, wherein said interlock means comprises a locking member movable between first and second positions, said first and second counter means each including movement stopping means, said movement stopping means permitting movement of said locking member to its second position when said first counter means counts a predetermined number of push button actuation strokes and said second counting means has not counted push button actuation strokes.

17. The combination lock of claim 16, wherein:

said third counter means is connected to said locking member to urge said locking member to its second position when said third counter means has counted a predetermined number of push button strokes.

18. A combination lock, comprising:

a plurality of push buttons actuatable between first and second positions, each of said push buttons having first and second force transmitting surfaces;

a plurality of interposers movably mounted on an interposer support and movable to a first position for engagement by a first force transmitting surface and to a second position for engagement by a second force transmitting surface of an associated push button;

first and second movably mounted actuation panels, said first actuation panel positioned to be actuated by interposers in their respective first positions and said second actuation panel positioned to be actuated by interposers in their respective second positions;

first and second pawl means carried, respectively, by said first and second actuation panels;

first and second rachet means for incrementing, respectively, by said first and second pawl means upon actuation of an associated panel by an interposer;

actuation counter means coupled to said push buttons for counting the actuations of said push buttons;

interlock means movable between a first position to a second position, said actuation counter means urging said interlock means to its second position in response to a predetermined count; and said first and second rachet means carrying stopping means for preventing said interlock means from moving to said second position in response to an incrementing of said second rachet means.

19. The combination lock of claim 18, wherein said interlock means further comprises:

a movable member having first and second projections thereon, said movable member movable to cause said first and second projections to move along a path to a second position, said first and second rachet means positioned to block at least one of said paths in response to a predetermined count on a selected one of said rachet means.

20. The combination lock of claim 19, wherein said interlock means further comprises:

a movable member having first and second projections thereon, said movable member movable to cause said first and second projections to move along a path to a second position, said first and second rachet means positioned to block at least one of said paths in response to a predetermined count on a selected one of said rachet means.

21. The combination lock of claim 18, wherein:

a plurality of interposers are provided for each of said push buttons, said interposer support being movable by interposer support moving means with each push button actuation to present another of said interposers associated with a selected push button to that push button.

22. The combination lock of claim 21, wherein:

said actuation counter means is defined by a toothed rack and cooperating pawl, said pawl coupled to said push buttons to increment said actuation counter means in response to each push button actuation.

23. The combination lock of claim 22, wherein:

said interposers are movably mounted on a portion of said toothed rack.

24. The combination lock of claim 22, further comprising:

means for disengaging said first and second pawl; and means for restoring said first and second rachet means to their respective initial positions.

25. The combination lock of claim 18, wherein:

said actuation counter means is defined by a toothed rack and cooperating pawl, said pawl coupled to said push buttons to increment said actuation counter means in response to each push button actuation.

26. The combination lock of claim 25, wherein:

said interposers are movably mounted on a portion of said toothed rack.

27. The combination lock of claim 25, further comprising:

means for disengaging said first and second pawl means of said first and second rachet means; and means for restoring said first and second rachet means to their initial unincremented position.

* * * * *